United States Patent [19]

Manabe

[11] Patent Number: 4,989,873

[45] Date of Patent: Feb. 5, 1991

[54] ROULETTE PLAYING DEVICE

[75] Inventor: Katsuki Manabe, Tokyo, Japan

[73] Assignee: Sigma Enterprises, Incorporated, Tokyo, Japan

[21] Appl. No.: 393,382

[22] Filed: Aug. 14, 1989

Related U.S. Application Data

[63] Continuation of Ser. No. 120,127, Nov. 13, 1987, abandoned.

[30] Foreign Application Priority Data

| | | | |
|---|---|---|---|
| Nov. 14, 1986 | [JP] | Japan | 61-271564 |
| Nov. 14, 1986 | [JP] | Japan | 61-271565 |
| Nov. 14, 1986 | [JP] | Japan | 61-271566 |
| Nov. 14, 1986 | [JP] | Japan | 61-175094 |
| Sep. 28, 1987 | [JP] | Japan | 62-243410 |

[51] Int. Cl.[5] ..... A63F 5/00

[52] U.S. Cl. ..... 273/142 R; 273/138 A; 273/142 B; 273/142 E

[58] Field of Search ..... 273/142 R, 142 A, 142 B, 273/142 E, 142 J, 138 R, 138 A

[56] References Cited

U.S. PATENT DOCUMENTS

| | | |
|---|---|---|
| 4,508,346 | 4/1985 | Salvucci . |
| 4,559,918 | 12/1985 | Ballerin et al. . |
| 4,632,088 | 12/1986 | Bruce . |

FOREIGN PATENT DOCUMENTS

| | | |
|---|---|---|
| 0101522 | 2/1984 | European Pat. Off. . |
| 0194388 | 9/1986 | European Pat. Off. . |
| 157465 | 11/1939 | Fed. Rep. of Germany . |
| 2609169 | 9/1976 | Fed. Rep. of Germany . |
| 2181230 | 11/1973 | France . |
| 59-18072 | 4/1984 | Japan . |
| 61-8704 | 3/1986 | Japan . |
| WO81/03432 | 12/1981 | PCT Int'l Appl. . |
| 414861 | 8/1934 | United Kingdom . |
| 2095565 | 10/1982 | United Kingdom . |

*Primary Examiner*—Edward M. Coven
*Assistant Examiner*—Jessica J. Harrison

[57] ABSTRACT

A roulette playing device includes a hitting device for releasing a ball onto a circular runway which comprises a first rotatable roller disposed upstream of an outlet, a second rotatable roller opposed to the first roller and spaced therefrom by a distance smaller than the diameter of the ball, and a driver for rotating the first and the second rollers in opposite direction to each other. Such arrangement makes it easy to spin and release the ball and to control the spin of the ball. A release device for feeding a ball to the hitting device comprises a blower for sending forth air to the outlet through a release passage upstream of the outlet, and a feeder for feeding balls one by one to the release passage. Such arrangement enables the ball released on the circular runway to be accelerated thereon.

19 Claims, 8 Drawing Sheets

ROULETTE PLAYING DEVICE

This application is a continuation of copending application Ser. No. 07/120,127, filed on Nov. 13, 1987, now abandoned.

BACKGROUND OF THE INVENTION

This invention relates to a roulette playing device played by releasing a ball into one of a number of ball pockets bearing betting marks.

The prior art of the field this invention belongs to is described in, e.g., Japanese Patent Publication Nos. 18072/1984 and 8704/1986.

The prior art roulette playing device comprises a roulette wheel, a circular runway and a circular wall, as major members. The roulette wheel is positioned at the center of the device and has a plurality of ball pockets bearing betting marks. The roulette wheel is whirled by a separate motor or other means. The circular runway surrounds the roulette wheel and has the running surface declined radially inward. The circular wall is set up from the outer boundary of the runway continuous therearound. A ball is let out from a release opening formed in the circular wall.

But in the conventional device described in Japanese Patent Publication No. 18072/1984 described above, a ball is released by a hitting device including an air pressure feeding mechanism. In order to release the ball at a high initial speed, the hitting device has to be large. In the hitting device using a bouncing force of a spring, it is impossible to cause a hit ball to spin at a constant speed or control the direction, speed, etc. of spin of the hit ball. In the case, for example, where a release passage is curved, it sometimes happens that the ball reduces its speed due to the resistance caused by touching portions of the interior surface of the release passage. Consequently, the ball which is hit and released onto the circular runway from the release opening is sometimes slow and does not always have a constant speed. This spoils roulette games.

On the other hand, games are played on the roulette playing device by players putting betting coins into slots formed in the device, anticipating the ball pocket identified by a betting mark into which the ball will go. Before and after release of the ball, putting betting coins into the slots is prohibited.

In the prior art device, the prohibition of putting betting coins into slots (NO BETTING) is timed manually, i.e., by an operator of a game center. That is, an operator watches the ball running on the circular runway to push a NO BETTING button or the like so as to timely reject the betting coins put in after the operation of the NO BETTING button. For automatic NO BETTING operation, it is proposed to reject the betting coins put in within a certain period of time from release of the ball.

In the device in which the NO BETTING operation is made manually by an operator, it is necessary for an operator to always attend to the device. The timing of the NO BETTING operation is irregular depending on surroundings, etc. in a game center. In the device in which the NO BETTING operation is automatically made after a certain period of time from release of the ball, the operation is badly timed when the ball goes astray.

Japanese Patent Publication No. 8704/1986 referred to above discloses the art of disposing ball sensors along the circular runway. But the sensors are for accelerating the ball with magnetic force and not for timing the NO BETTING operation.

SUMMARY OF THE INVENTION

A first object of this invention is to provide a roulette playing device which can spin out a ball or control its spin.

A second object of this invention is to provide a roulette playing device which can hit and spin a ball and can accelerate the ball released on the circular runway.

A third object of this invention is to provide a roulette playing device which can control the running speed of the released ball on the circular runway and detect the run of the ball, so as to stabilize the timing of NO BETTING, whereby roulette games are made more amusing.

A roulette playing device according to this invention which is provided to attain the first object of this invention comprises a rotary roulette wheel having a plurality of ball pockets with betting marks; a circular runway inclined and surrounding the roulette wheel; and a circular wall provided around the outer edge of the circular runway continuously thereto and having an opening for a ball to be released through; a hitting device for releasing the ball onto the circular runway from said opening through an outlet; and a release device for feeding balls one by one to said hitting device. The hitting device comprising a first rotatable roller provided upstream of said outlet, a second rotatable roller opposed to said first roller with an opening therebetween which is smaller than the diameter of the ball, and drive means for driving said first and said second rollers in opposite directions to each other. The ball which has been fed by said release device and hit out by the rotation force of said first and second rollers being released through said release passage.

A roulette playing device according to this invention which is provided to attain the second object of this invention comprises a rotary roulette wheel having a plurality of ball pockets with betting marks; a circular runway inclined and surrounding the roulette wheel; and a circular wall provided around the outer edge of the circular runway continuously thereto and having an opening for a ball to be released through; a hitting device for releasing the ball onto the circular runway from the opening through an outlet; and a release device for feeding balls one by one to the hitting device. The hitting device comprising a first rotatable roller provided upstream of the outlet, a second rotatable roller opposed to the first roller with an opening therebetween which is smaller than the diameter of the ball, and drive means for driving the first and the second rollers in opposite directions to each other. The release device comprising blower means for sending forth air toward the outlet through a release passage communicating with the upstream side of the outlet, and feeding means for feeding balls one by one to the release passage. The ball which has been fed by the release device and hit out by the rotation force of the first and second rollers being released through the release passage.

A roulette playing device according to this invention which is provided to attain the third object of this invention comprises a rotary roulette wheel having a plurality of ball pockets with betting marks; a circular runway inclined and surrounding the roulette wheel; and a circular wall provided around the outer edge of the circular runway continuously thereto and having an opening for a ball to be released through; a hitting device for releasing the ball onto the circular runway from the opening through an outlet; and a release device for feeding balls one by one to the hitting device. The hitting device comprising a first rotatable roller provided upstream of the outlet, a second rotatable roller opposed to said first roller with an opening therebetween which is smaller than the diameter of the ball, and drive means for driving the first and the second rollers in opposite directions to each other. The release device comprising blower means for sending forth air toward the outlet through a release passage communicating with the upstream side of the outlet, and feeding means for feeding balls one by one to the release passage. At least one ball sensor for detecting the running of the ball on the circular runway past the same is disposed on the circular wall. If a plurality of sensors are provided, they are spaced from each other at a certain intervals. Detecting means are provided for detecting a time between the time when one of the ball sensors detects the ball and that when a next ball sensor detects the ball, or an average speed is detected based on outputs of the ball sensors.

Control means are also provided for outputting a NO BETTING instruction when a detected value of the detection means reaches a set value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
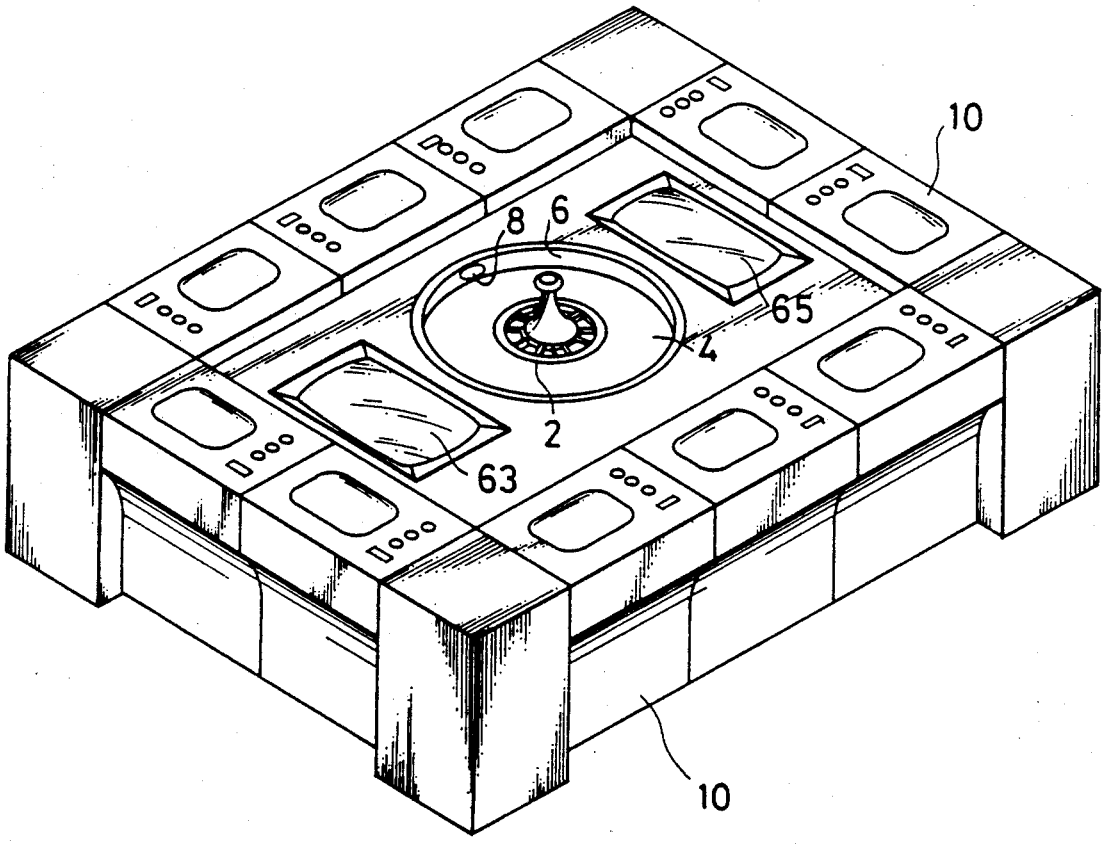
FIG. 1 is a perspective view showing the roulette playing device according to this invention.

The roulette playing device shown in FIG. 1 has a rotatable roulette wheel 2 disposed at the center thereof. The roulette wheel 2 is surrounded by a circular runway 4 which is declined radially inward. Along the outer boundary of the circular runway 4, a circular wall 6 is provided continuously therearound. In the circular wall 6 there is formed a release opening 8 for letting out a ball 20 onto the circular runway 4. Ten, for example, terminal roulette playing devices 10 are provided around the roulette playing device. Players use the terminal roulette playing devices 10.

Figure 2:
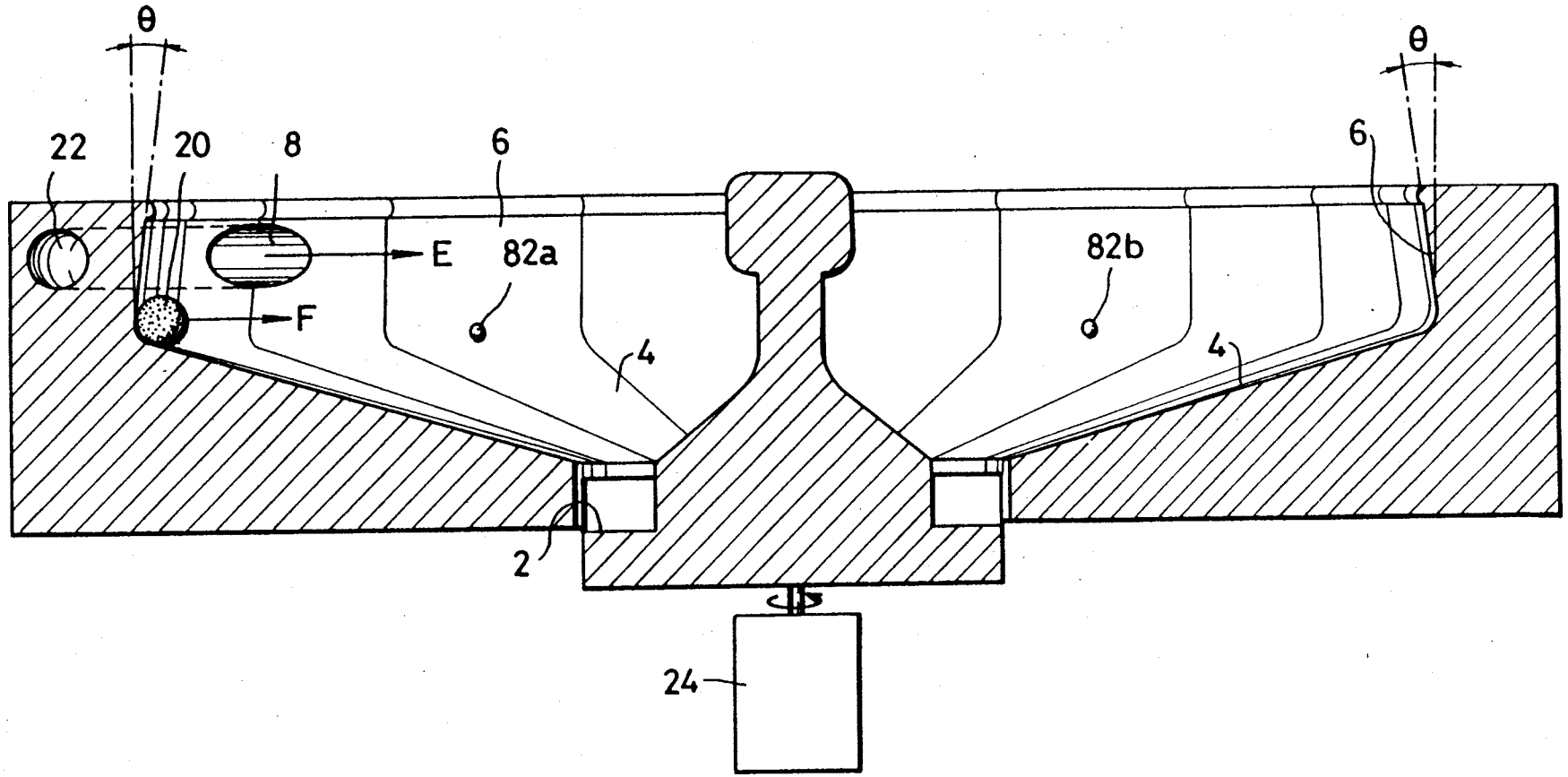
FIG. 2 is a side section view of a major portion of the roulette playing device according to an embodiment of this invention.

The major portion of the roulette playing device shown in FIG. 1 is shown in FIG. 2. The circular runway 4 and the circular wall 6 are made continuous. The circular wall 6 is tilted inward from the vertical plane by an angle $\theta$. The joint between the circular runway 4 and the circular wall 6 has a curvature radius slightly smaller than the radius of the ball 20. This arrangement brings the ball 20 running along the outermost circumference of the circular runway 4 into contact with the circular runway 4 and the circular wall 6 at the points A and B in FIG. 3.

Figure 3:
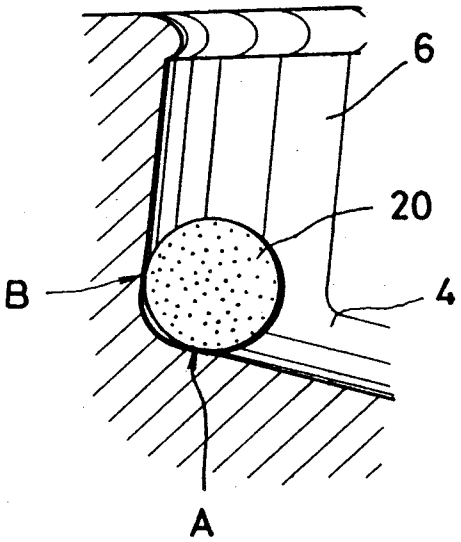
FIG. 3 is an enlarged view of the portion neighboring the circular wall in FIG. 2.

The release opening 8 is located on a level higher than the level where the ball 20 runs along the outermost circumference of the circular runway 4, i.e., at a position where the lower end of the release opening 8 is higher than the contact point of the ball 20 to the circular wall 6 (point B in FIG. 3). The release opening is in communication with an outlet 22. The roulette wheel 2 having betting marks (e.g., numbers) is whirled by a motor 24 in the direction indicated by the arrow in FIG. 2.

Figure 4:
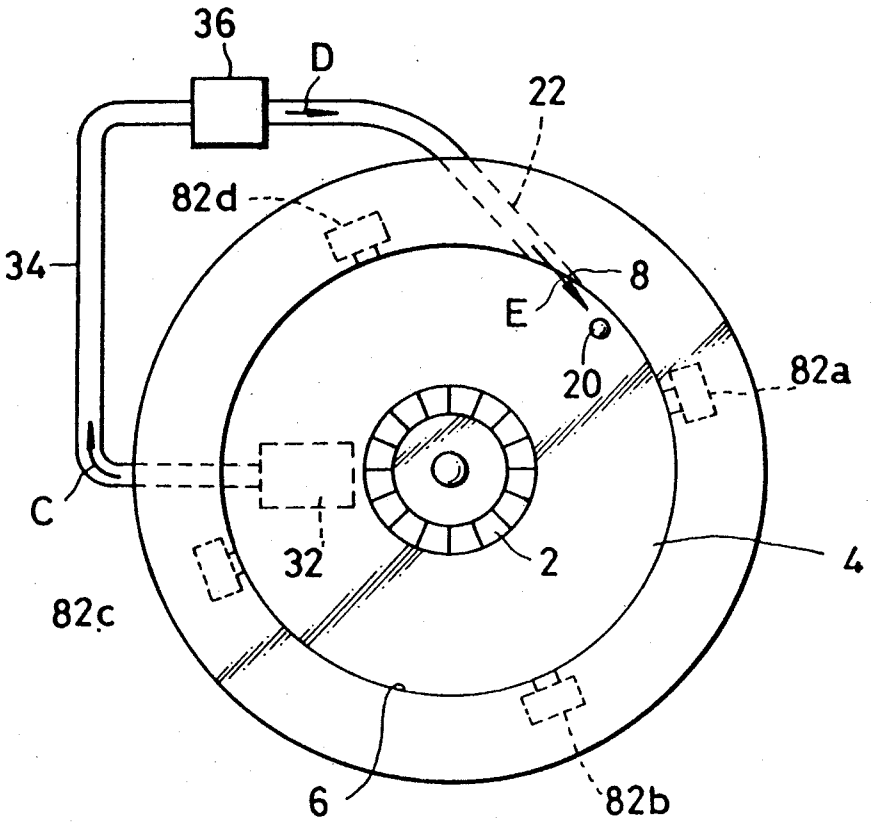
FIG. 4 is a plan view of the major portion of the roulette playing device according to the embodiment, showing an arrangement of the members.
Figure 5:
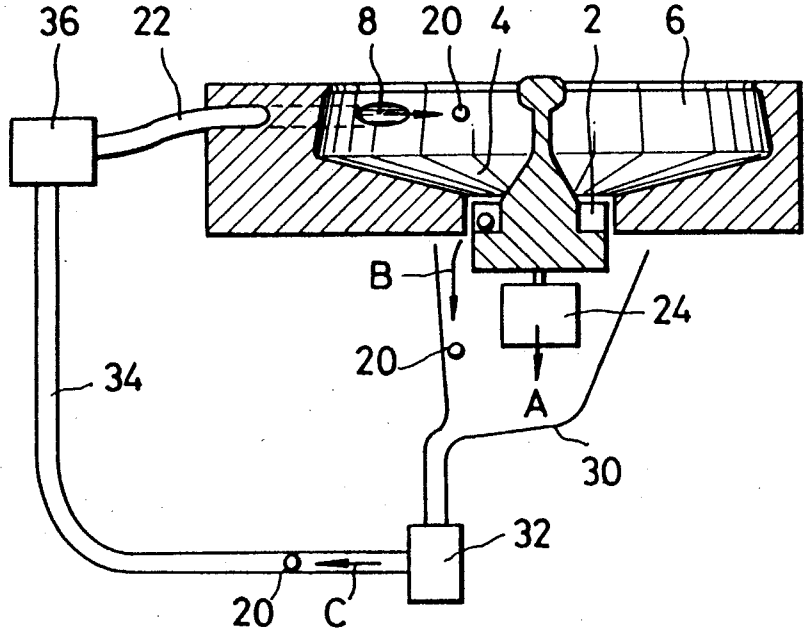
FIG. 5 is a view of the interior construction of the roulette playing device according to the embodiment, showing an arrangement of the members.

FIG. 4 is a plan view showing an arrangement of the major portion of the embodiment shown in FIGS. 1, 2 and 3. FIG. 5 shows a sectional view of FIG. 4. A funnel-shaped recovery member 30 for receiving the falling ball 20 is provided below the roulette wheel 2. The recovered ball is sent to a release device 32. The release device 32 sends out the ball 20 into a release passage 34. A hitting device 36 hits the ball 20 from the release passage into an outlet 22.

Figure 6:
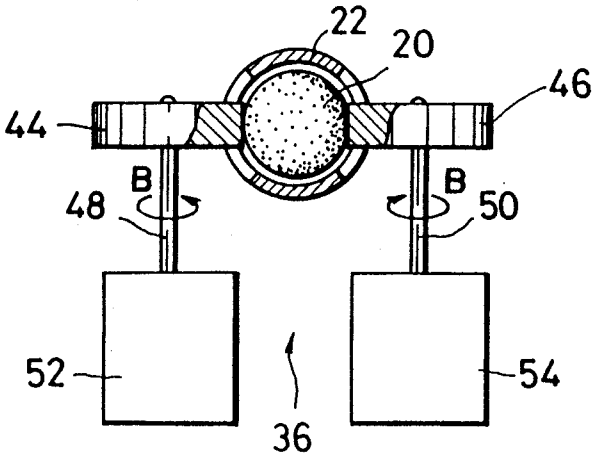
FIG. 6 is a view explaining the structure of the hitting device characterizing the roulette playing device according to the embodiment.
Figure 7:
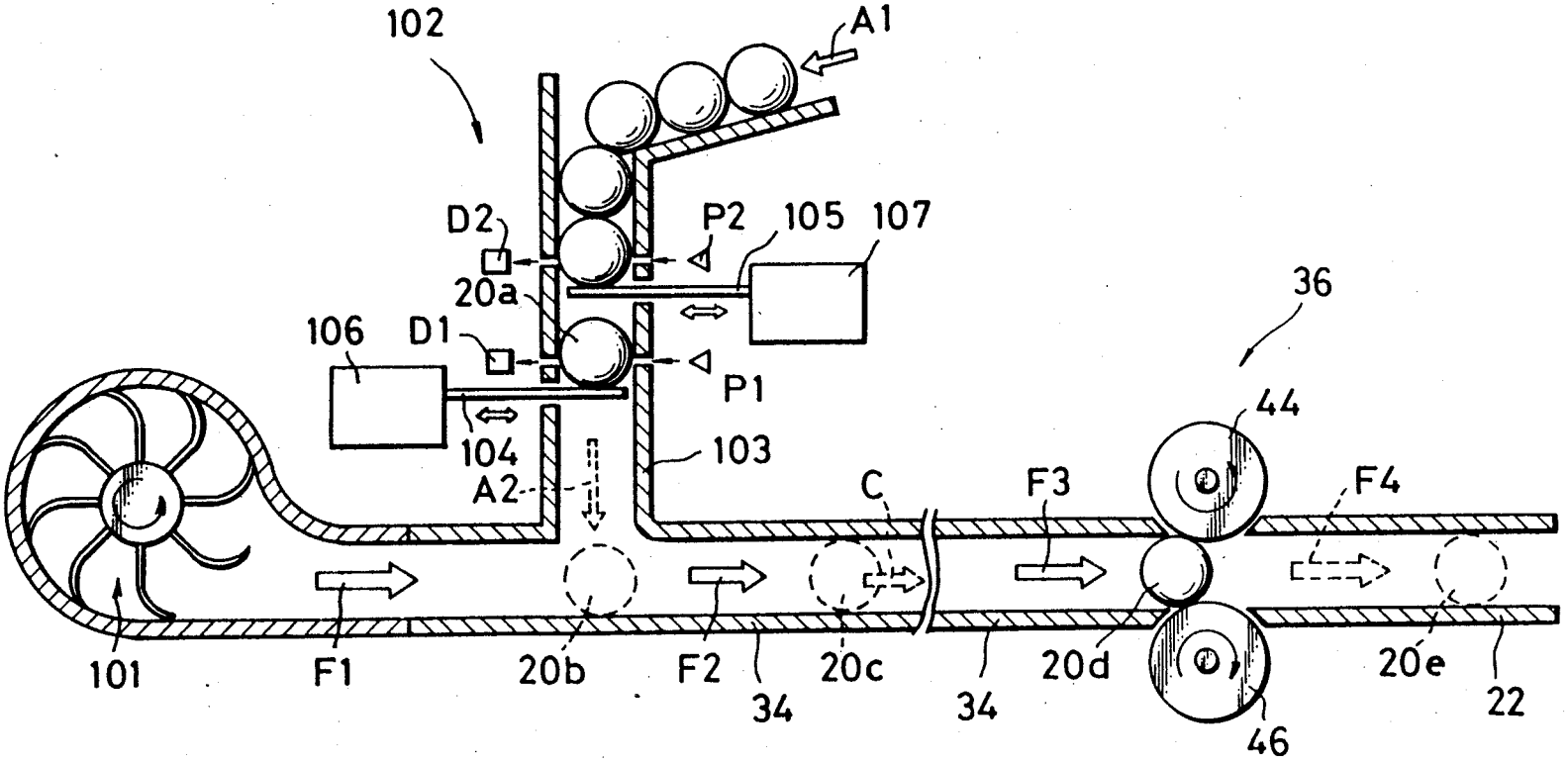
FIG. 7 is a side view explaining the structures of the release device and the hitting device characterizing the roulette playing device according to the embodiment.

The ball 20 is hit and released by the devices shown in FIGS. 6 and 7. As seen in FIGS. 6 and 7, openings are formed on both sides between the release passage 34 and the outlet 22, and in the openings a first roller and a second roller 44, 46 are opposed to each other. The opening between the first and the second rollers is made a little smaller than the diameter of the ball 20. The first and the second rollers 44, 46 are connected respectively to spindles 48, 50 to be rotated respectively by first and second motors 52, 54. The directions of rotation of the rollers are opposite as indicated by the arrows at (B) in FIGS. 6 and 7.

As shown in FIG. 7, a release device 32 which releases balls one by one is disposed upstream of the release passage 34 communicating with the outlet 22. The release device 32 comprises a blower 101 for forcing air from the release passage 34 to the outlet 22, and a ball feeder 102 for dropping balls one by one ahead of the blower 101. Two shutters 104, 105 are inserted in the opening formed in a feed passage 103 which is a part of the ball feeder 102. The shutters 104, 105 are driven by solenoid drive sections 106, 107 in the direction indicated by the arrow in FIG. 7. In the feed passage 103 there is disposed a ball sensor which comprises light sources P1, P2, and photo detector elements D1, D2.

Figure 8:
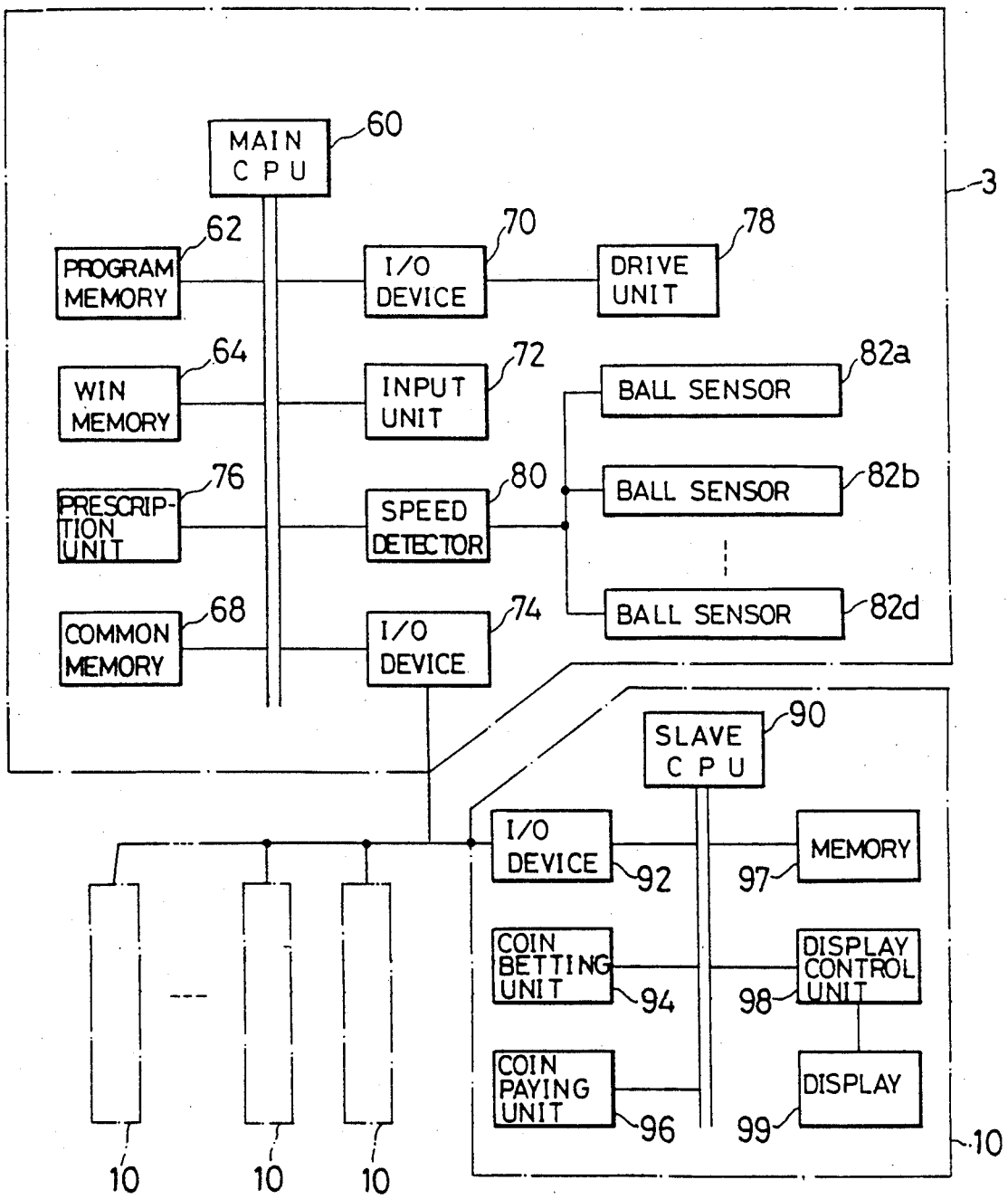
FIG. 8 is a block diagram of the control unit of the roulette playing device according to the embodiment.

A control unit of the roulette playing device according to an embodiment of this invention is arranged as shown in FIG. 8. A main CPU 60 which controls generally the roulette playing device is connected by a bus to a program memory 62, a win memory 64 and a common memory 68. The program memory 62 stores roulette game programs. The win memory 64 stores winning betting marks and their winning times, etc. The common memory 68 stores various data. The main CPU 60 is connected also to an I/O device 70 and an input unit 72. The I/O device 70 passes data between a drive unit 78 and the main CPU 60. The drive unit 78 provides a motor or the like which whirls the roulette wheel 2. In the input unit 72, a game starting instruction, etc. is inputted by e.g. an operator.

The main device 3 comprising the above-described elements is connected to terminal roulette playing devices 10 through the I/O devices 74, 92. Each terminal roulette playing device 10 has a slave CPU 90 which controls generally the device 10. The CPU 90 is connected by a bus to a coin receiving unit 94, a coin paying unit 96, a memory 97, and a display control unit 98. The coin receiving unit 94 receives the betting coins put in and counts the number of the betting coins. The coin paying unit 96 pays out a certain number of coins to the players who have won a game. The memory 97 stores programs for the slave CPU 90, a number of the betted coins, etc. The display control unit 98 controls the display in a display 99 in accordance with an instruction of the slave CPU 90.

The roulette playing device according to the embodiment is characterized in that the device contains in the main device 3 a prescription unit 76, a speed detector 80, and four ball sensors 82*a*–82*d*. The prescription unit 76 sets a given value corresponding to a timing of NO BETTING. The ball sensors 82*a*–82*d* sense the ball 20 running on the circular runway 4 past the ball sensors. The ball sensors are disposed on the boundary between the circular runway 4 and the circular wall 6 as indicated by 82*a*, 82*b* in FIG. 2. The speed detector 80 detects a running speed of the ball 20 based on a time difference between the times when the ball 20 passes two adjacent ones of the ball sensors 82*a*–82*d*, and on a preset distance between the two ball sensors 82*a*–82*d*.

Next, the operation of the roulette playing device according to the embodiment will be explained.

For explanation, the roulette playing device is started with a ball 20 located on the roulette wheel 2. First, the roulette wheel 2 lowers together with the drive motor 24 in the direction indicated by the arrow A. Then the ball 20 on the roulette wheel 2 falls down the recovery member 30 in the direction indicated by the arrow B and into the release device 32. The balls 20 thus received in the release device 32 are stored one after another firstly at the position indicated by the arrow A1 in FIG. 7. A first ball 20*a* has been detected by the ball sensor comprising the light source P1 and the photo detector element D1, and the shutter 104 moves back to allow the ball 20*a* to drop in the direction indicated by the arrow A2. The ball 20*b* thus dropped is caused to move in the release passage 34 in the direction of the arrow C by the air fed by the blower 101 in the direction of the arrows F1, F2 (ball 20*c*). Then the ball 20*d* is caught by a first and a second rollers 44, 46. During this operation, the shutter 104 moves forward, and the shutter 105, which has moved back, moves forward again. Then a next ball is set as shown in FIG. 7.

The ball 20 in the hitting device 36 is hit out synchronously with the start of a game, i.e., when players have put betting coins in terminal roulette playing devices 10 shown in FIG. 1 or are ready to do so, and besides the roulette wheel 2 is being whirled by the drive motor 24. Then, the ball 20 hit out passes through the outlet 22 in the direction indicated by the arrow D and is released onto the circular wall 6 as indicated by the arrow E.

The ball hitting operation by the hitting device 36 will be explained. The ball sent by the release device 32 is caught in the opening between the first and the second rollers 44, 46. Since the first and the second rollers 44, 46 are rotated respectively by motors 52, 54 in the direction indicated by the arrow, the ball 20 is biased and hit out into the outlet 22.

In the embodiment, since an air pressure fed from the blower 101 is used to set a ball in the hitting device 36, the ball 20 is caught in the opening between the rollers 44, 46 without failure. The possibility of wrong setting is very low. If a wrong setting takes place, it will suffice to increase the air pressure. Specifically, a sensor for detecting a ball 20 caught between the rollers 44, 46 is provided between the rollers 44, 46, and when the sensor detects a wrong setting of a ball, the rotation number of the drive motor for the blower 101 is increased correspondingly. The sensor for detecting a ball may be an optical sensor which comprises a pair of a light emitting element and a photodetector or may be a microswitch.

When a ball 20 is hit out by the hitting device, the rotation speeds of the rollers 44, 46 are made different from each other so that the ball 20 is spinned as required. The ball 20 goes on spinning while passing through the outlet 22, and even after the ball 20 is released from the opening 8, the ball 20 still keeps spinning constantly.

It produces the following remarkable advantageous effects that in this embodiment the ball can be released spinned. As a first advantageous effect, even when the outlet 22 is curved, a ball can be let out at a high speed. For example, in the case where the outlet 22 is curved right with respect to the direction of travel of a ball 20, the ball 20 is spinned left thereby to minimize the resistance due to the contact of the ball to the outlet 22. As a second advantageous effect, in the embodiment in which the ball runs on the circular runway 4 right of the circular wall 6, the ball 20 is spinned left so that the ball 20 may run on the circular runway smoothly. Another advantageous effect is that the ball 20 can be caused to behave variously by adjusting the direction of spin of the ball 20 or the rotation speed of the ball 20.

Immediately after the ball 20 is hit out, it follows the path indicated by the arrow E in FIG. 2. At this time, gravity acts on the ball 20 downward, but since the circular wall 6 is tilted inward by an angle $\theta$ in the embodiment, a centrifugal force acts on the ball 20 outward, accordingly a component acting downward. Then the ball 20 rolls down the circular wall 6 gradually downward to reach the lower end of the circular wall 6 by the time the ball 20 makes at least one round run along the circular wall 6.

When the ball 20 comes round back to the position where the release opening is located, the balls 20 is in the running path indicated by the arrow E in FIG. 2. It does not happen that the ball 20 falls into the release opening, and accordingly the running path of the ball 2 is not disturbed. As seen from the above explanation, the inclination angle $\theta$ of the circular wall 6 is determined by a centrifugal force and gravity. That is, since a downward component is larger as a larger centrifugal acts on the ball 20, the inclination angle $\theta$ may be small. Besides, as more gravity acts on the ball 20, the inclination angle may be smaller.

In the embodiment, the air fed from the blower 101 is blown from the opening 8 through the release passage 34 and the outlet 22 to flow along the circular wall 6. The air thus flowing accelerates the ball 20, so that even if the ball is hit out at a low speed, the ball 20 can run at a sufficiently high speed. Accordingly, it does not happen that the ball 20 has to be hit out at such a high speed that the ball may go astray outside and go over the circular wall 6.

Figure 9:
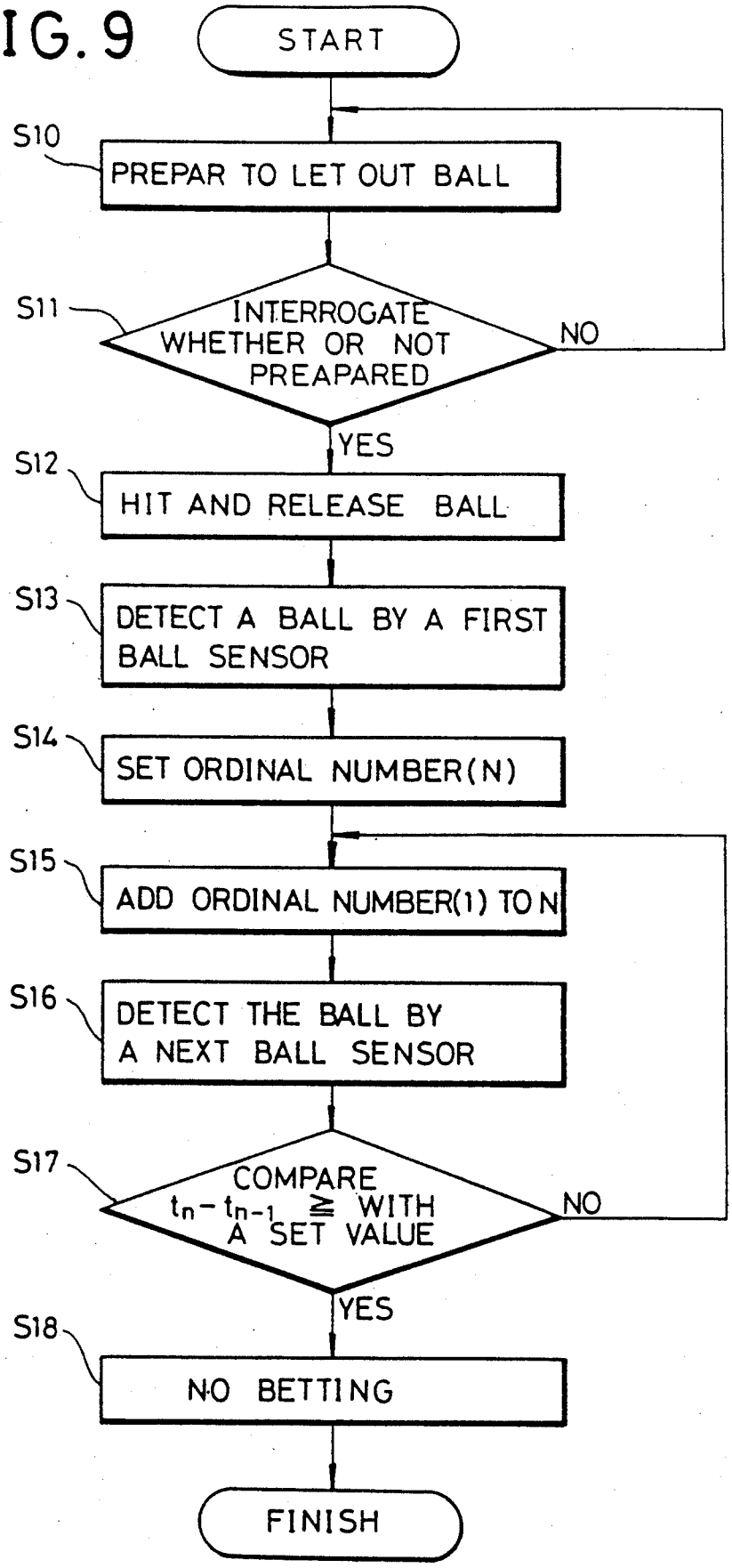
FIG. 9 is a flow chart explaining the operation of the control unit of FIG. 8.

Next, with reference to the flow chart of FIG. 9, the operation up to the NO BETTING will be explained. First, the preparation for letting out the ball 20 is made (S10). When the preparation is completed (S11), the ball is hit out by the hitting device 36 to be released from the release opening 8 (S12). The ball 20 released onto the circular wall 6 first passes the ball sensor 82*a*. The ball sensor 82*a* first detects the ball 20 to input the time TO when the ball 20 passed the sensor 82*a* to the speed detector 80 (S13). An ordinal number of the detection, n=0, is inputted (S14). The ordinal numbers are set in, e.g., a RAM incorporated in the device. In order to detect the ball 20 accurately it is preferable to dispose the ball sensors 82*a*–82*b* on the boundary between the circular runway 4 and the circular wall 6. By locating the ball sensors 82*a*–82*b* especially at the points A and B in FIG. 3, the possibility of ball detection error can be much lowered.

Next, 1 is added to the ordinal number n (S15), when all is set for a next detection of the ball 20. The time when the next ball sensor 82*b* detects the ball 20 is inputted as $T=t_n$ (S16). Then the difference between the time of the former ball detection and that of the latter is given as follows;

$$\begin{aligned}\Delta T &= t_n - t_{n-1}\\ &= t_1 - t_0.\end{aligned}$$

Then, the difference $\Delta T=t_1-t_0$ is compared with a preset value which has been inputted to the prescription section 76 (S17). Since the distance between the ball sensors 82*a* and 82*b* are known, the speed is compared indirectly.

When $\Delta T=t_1-t_0$ is short of the preset value, 1 is added to the ordinal number n to make n=2 (S15), when all is set for a next ball detection. When the ball sensor 82*c* detects the ball 20, the difference between the time $T=t_2$ when the ball 20 passed the sensor 82*c* and the time $T=t_1$ is given as follows;

$$\begin{aligned}\Delta T &= t_n - t_{n-1}\\ &= t_2 - t_1.\end{aligned}$$

Then the difference $\Delta T=t_2-t_1$ is compared with the preset value (S17).

This processing is repeated, and when a difference $\Delta T=t_n-t_{n-1}$ between the times thus detected is larger than the preset value, it is judged that the speed of the ball has become lower than the preset value, and a NO BETTING operation is made (S18). The NO BETTING operation is carried out by the main CPU 60 in accordance with the procedures stored beforehand in, e.g., a program memory 62.

According to the embodiment, the time to NO BETTING can be controlled as required. That is, the running time of the ball 20 can be controlled by varying the pressure of the air blown out of the opening 8 by the blower 101 through the release passage 34 and the outlet 22. In other words, since the ball 20 is accelerated inside the circular wall 6 by the air pressure fed by the blower 101, the time until a difference between the times of the ball detections $$\Delta T=t_n-t_{n-1}$$

becomes lower than a given value and can be selectively controlled.

When NO BETTING is operated, the ball 20 runs on the circular runway 4 gradually to the center thereof and finally enter one ball pocket with a betting mark. An optical sensor (not shown) detects which pocket identified with a mark the ball has entered. The detection signal is sent to the slave CPU 90, and when the game is won, a given number of coins are paid out of the coin paying unit 96.

The number of the coins thus paid is given to the main CPU 60 and stored in an addition memory 66. The displays 63, 65 shown in FIG. 1 indicate the winning terminal roulette playing device and the amount won.

This invention is not limited to the above-described embodiment and can be modified without departing from the claimed scope of this invention.

To give examples, as shown in Japanese Patent Publication No. 18072/1984, two release openings 8 may be formed, opening in opposite directions to each other. The path along which the ball 20 is released from the release opening 8 may be slightly declined downward. The path may be directed slightly inward with respect to the circumferential direction of the circular wall 6.

The vertical circular wall 6 is not necessarily plan and may be concave, for example. A gutter of concave cross-section for receiving the ball 20 may be formed in the direction indicated by the arrow F in FIG. 2.

In the embodiment, four ball sensors are provided, but the number of the ball sensor is not limited to four. Three or less than three, or five or more than five ball sensors may be provided. Most preferably the ball sensor uses an optical sensor in which light is applied to the ball from a light emitting element, and the reflected light from the ball is detected. But detection may be made by the reflection of ultrasonic wave, the interruption of incident light on the ball sensor by the ball, or others.

The value set in the prescription section may be constant or variable. For example, in a first game an operator times the NO BETTING operation, and based on the timing (a running speed of the ball) determined in the first game a value is preset. In the following games the NO BETTING operation is made based on the preset value. In this case it is necessary to store the running speed of the ball (output of the speed detector) when an operator made a NO BETTING operation in, e.g. a RAM or others buit in the prescription section and to use the stored value as a set value in the prescription section.

In the hitting device, the ball can be spinned by a single motor by making the diameters of the first and the second rollers different from each other. The first and the second rollers 44, 46 may be rotated by a single motor and transmission means, such as gears or belts. The shape of the first and the second rollers is not necessarily disk-shaped but may be ball-shaped.

Figure 10:
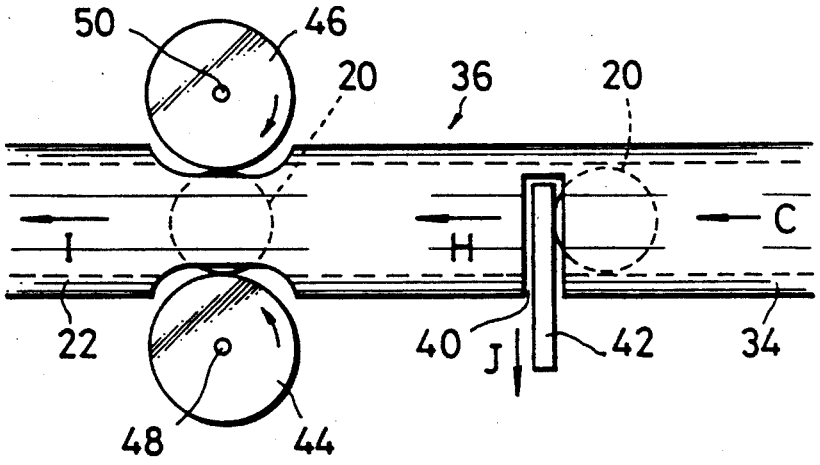
FIG. 10 is a view explaining the structure of another example of the release device.

The hitting device 36 may be as shown in FIG. 10. That is, a slit is formed in the release passage 34 at the upstream side of the first and the second rollers, and the shutter 42 is disposed in the slit. The shutter 42 is slided in the direction of the arrow J to allow the ball 20 which has run in the direction of the arrow C to run in the direction of the arrow H, and is released by the first and the second rollers in the direction indicated by the arrow I. The release device may have the same structure as the hitting device shown in FIG. 6 or may comprise a known coil spring or solenoid spring.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A roulette playing device comprising:

a rotatory roulette wheel having a plurality of ball pockets with betting marks;

an inclined, substantially circular runway surrounding the roulette wheel;

a substantially circular wall provided around an outer edge of the substantially circular runway continuously thereto and having an opening defined therein for a ball to be released through;

hitting means for releasing the ball into said substantially circular runway from said opening through an outlet, said hitting means comprising a first rotatable roller provided upstream of said outlet, a second rotatable roller with an opening therebetween which is smaller than the diameter of the ball, and drive means for driving said first and second rollers in opposite directions to each other;

release means for feeding balls one by one to said hitting means, said release means comprising a pair of reciprocable shutters positionable within a feed passage, said feed passage receives balls at one end thereof and is connected to the release passage at another end thereof, said release means further including reciprocation means for sequentially moving the shutters into and out of the feed passage to thereby feed the balls one by one; and press means for pressing the fed ball against said first and second rotatable rollers of said hitting means, the ball pressed against said first and second rotatable rollers by said press means being hit out by rotation of said first and second rollers to be released through a release passage leading to the outlet and then through said outlet.

2. The roulette playing device according to claim 1, wherein said first and said second rollers have different rotation speeds from each other.

3. The roulette playing device according to claim 1, wherein said first and said second rollers have different radii from each other.

4. The roulette playing device according to claim 1, wherein said press means comprises blower means for sending air toward said outlet through the release passage communicating with an upstream side of said outlet.

5. The roulette playing device according to claim 1, wherein the pressure of the air supplied by said blower means is controllable.

6. The roulette playing device according to claim 4, wherein the blower means is positioned upstream of said first and second rollers whereby the air therefrom accelerates the ball which has been hit out by said hitting means.

7. The roulette playing device according to claim 1, further comprising sensor means for detecting balls within the feed passage and control means for operating the reciprocation means when the sensor means detects balls in the feed passage.

8. The roulette playing device according to claim 7, wherein the sensor means comprises at least one sensor positioned above an upper one of the pair of shutters for detecting a ball in the feed passage upstream of the release means.

9. The roulette playing device according to claim 8, wherein the sensor is a photo detector and light source.

10. The roulette playing device according to claim 7, wherein the sensor means comprises at least one sensor positioned between the two shutters of the pair of shutters for detecting a ball in the feed passage which ball is next to be fed to the hitting means.

11. The roulette playing device according to claim 10, wherein the sensor is a photo detector and light source.

12. The roulette playing device according to claim 7, wherein the sensor means comprises two sensors, a first one of the sensors being positioned above an upper one of the pair of shutters for detecting a ball in the feed passage upstream of the release means, a second one of the sensors being positioned between the two shutters of the pair of shutters for detecting a ball in the feed passage which ball is next to be fed to the hitting means.

13. The roulette playing device according to claim 12, wherein the first and second sensors are each a photo detector and light source.

14. The roulette playing device according to claim 1, wherein a plurality of balls are used and wherein the release means ensures that only one ball at a time is fed to the hitting means.

15. A roulette playing device comprising:

a rotary roulette wheel having a plurality of ball pockets with betting marks;

an inclined, substantially circular runway surrounding the roulette wheel;

a substantially circular wall provided around an outer edge of the substantially circular runway continuously thereto and having an opening defined therein for a ball to be released through;

hitting means for releasing the ball onto said substantially circular runway from said opening through an outlet path, said hitting means comprising a first rotatable roller and a second rotatable roller provided on the way of said outlet path with an opening therebetween which is smaller than the diameter of the ball, and drive means for driving said first and second rollers in opposite directions to each other;

supply means for supplying a ball to upstream of said hitting means; and blower means for moving the ball supplied in said outlet path by said supply means to a hitting position of said hitting means, at which the ball is hit by said hitting means, said ball being pressed at the hitting position against both of said first and second rotatable rollers by air flow generated by said blower means until the ball is hit out by the hitting means.

16. The rouletter playing device as recited in claim 15, wherein the supply means includes release means for feeding balls one by one to the hitting means.

17. The roulette playing device according to claim 15, wherein said first and said second rollers having different rotation speeds from each other.

18. The roulette playing device according to claim 15, wherein the pressure of the air supplied by said blower means is controllable.

19. The roulette playing device according to claim 15, wherein the blower means is positioned upstream of said first and second rollers and the blower means continues to supply air to the outlet path after the ball is hit out by the hitting means to thereby accelerate the ball.

* * * * *